US005746654A

United States Patent [19]

Peak

[11] Patent Number: 5,746,654

[45] Date of Patent: May 5, 1998

[54] VENTILATOR

[75] Inventor: Richard Allan Peak, Colchester, United Kingdom

[73] Assignee: Titon Hardware Limited, United Kingdom

[21] Appl. No.: 655,694

[22] Filed: Jun. 3, 1996

[30] Foreign Application Priority Data

Jun. 2, 1995 [GB] United Kingdom ..... 9511202

[51] Int. Cl.[6] ..... F24F 13/18

[52] U.S. Cl. ..... 454/211; 454/213; 454/271; 454/273

[58] Field of Search ..... 454/211, 213, 454/214, 215, 271, 273, 195; 285/4

[56] References Cited

U.S. PATENT DOCUMENTS

| | | | |
|---|---|---|---|
| 1,783,605 | 12/1930 | Della | 285/4 |
| 1,789,135 | 1/1931 | Chiniewicz | 454/273 |
| 4,475,324 | 10/1984 | Flakk | 52/209 |
| 4,485,730 | 12/1984 | Baus . | |
| 4,957,038 | 9/1990 | Hamilton . | |
| 5,137,492 | 8/1992 | Archer et al. | 454/213 |
| 5,376,044 | 12/1994 | Tippin et al. | 454/211 |
| 5,588,267 | 12/1996 | Rodriguez et al. | 285/4 |

FOREIGN PATENT DOCUMENTS

| | | | |
|---|---|---|---|
| 17752 | of 1889 | United Kingdom | 454/271 |
| 1210654 | 10/1970 | United Kingdom . | |
| 2224826 | 5/1990 | United Kingdom . | |
| 2230851 | 10/1990 | United Kingdom . | |

*Primary Examiner*—Harold Joyce

*Attorney, Agent, or Firm*—Price, Heneveld, Cooper DeWitt & Litton

[57] ABSTRACT

A vented frame (1) includes an air passage of L-shaped section having a horizontal portion (8) and a vertical portion (9). A ventilator (7) is inserted into the vertical portion and comprises an elongate main body with first and second openings (10), (11) diametrically opposed to one another. A closure member controls the passage of air through the ventilator. The ventilator consists of two parts which are separable from one another and, once installed, the lower of the two parts can be replaced or repaired, while the other part is left in place.

16 Claims, 3 Drawing Sheets

VENTILATOR

The present invention relates to ventilators, for example for use in rooms with sealed windows and/or double glazing where it is desirable to provide ventilation without having to open the window. This type of ventilation is often referred to as "secondary ventilation".

Secondary ventilation is often achieved by the insertion of a slot ventilator into a slot cut or formed in the frame or sash of a window. Air flow through the resultant ventilation passage between the interior and exterior of the building is controlled for example by an openable and closeable ventilator such as a hit and miss ventilator or a parallel motion ventilator of the type described in UK Patent 1417751.

The slot is of course necessarily provided at the periphery of the window and when in the frame this can give rise to problems when an interior finish such as, for example, layers of insulation and plasterboard (dry-liner), or tiles is applied for example to an adjacent ceiling and window reveal as such interior finishes may obstruct or restrict access to the ventilator inserted in the slot. Accordingly it has been suggested that the slot be cut diagonally in the frame, extending inwardly, that is, towards the centre of the window. The outer opening of the slot needs to be as high as possible to minimize ingress of rain, and the inner opening lower to avoid obstruction by the dry liner. That arrangement has however proved unsatisfactory for various reasons. Firstly, the angle of the slot is constrained by the shape of the frame as a result of which the ventilator may still not adequately clear the interior finish. Secondly the dimension of the opening of the slot to the exterior is larger than for a conventional, non-diagonal, slot which will give rise to more water ingress. In addition, the downward slope of the slot means that any water entering the slot will run down to the ventilator.

A solution to the problem is to provide a dog-leg, or L-shaped slot through the frame, having a horizontal leg i.e. substantially normal to the plane of the window or frame extending from the exterior and (when the slot is provided at the top of the window) a downwardly directed vertical leg communicating with the interior. The ventilator is inserted in the vertical leg, opening into the interior at its lower end and having the closure member at that end. Once the interior finish has been applied, however, the ventilator is e.g. plastered in place. Accordingly, if it is desired to repair or replace the ventilator, for example because the closure member is jammed, it is necessary to disturb the interior finish in order to remove the ventilator. The operation is, therefore, very time consuming and can lead to damage to the interior finish.

According to the invention there is provided a vented frame including an air passage extending from the exterior to the interior of the frame, and a ventilator positioned at the interior of the frame and communicating with the air passage, the ventilator comprising a main body having separable first and second parts, a first ventilation opening being provided in the first part at an end of the ventilator remote from the periphery of the frame. When it is desired to remove the first part of the ventilator, it can simply be detached from the second part and removed, and the second part can be left in place, as a result of which there is no disturbance to the interior finish. A replacement or repaired first part can subsequently be inserted.

The air passage may comprise an L-shaped slot having a first leg extending substantially transverse to the plane of the frame from the exterior of the frame and a second leg extending substantially normal to the first leg.

A closure member may be associated with the first opening for covering and uncovering the first opening.

The first part and the second part may be releasably attached to one another For example, they may be screwed together, connected by a snap fit, or cast, moulded or extruded integrally together, a weak line (for example a line along which the thickness of the walls of the ventilator is reduced) being provided at the boundary between the parts. Alternatively the first part may overlap the second part at the boundary between the parts. As a result, it may be necessary only to secure the first part in the slot, the second part being held in place by the attachment to the first part, or by virtue of the overlap between the parts. Once the interior finish has been applied, the second part may be plastered or otherwise affixed in place.

The main body may have a second ventilation opening in the second part, an air passage communicating between the openings.

The ventilator may be formed from a plurality of adjacent units.

The main body of the ventilator may comprise a plate.

The main body may be elongate and hollow and rectangular cross-section, each opening being provided on a respective long wall of the main body adjacent one long edge thereof, the openings being substantially located at respective ends of an imaginary diagonal line drawn through the cross-section of the main body.

The first and second parts may be joined along lines parallel to the long edges of the main body.

According to the invention there is further provided a vented frame including an air passage of L-shaped section having a first leg extending substantially transverse to the plane of the frame from the exterior of the frame, and a second leg extending substantially normal to the first leg and a ventilator positioned in the second leg comprising a main body having a first opening for communicating with the interior and a second opening for communicating with the exterior via the L-shaped passage and an air passage communicating between the openings, the first opening being provided at an end of the ventilator remote from the periphery of the frame.

Embodiments of the invention will now be described by way of example with reference to the drawings of which:

Figure 1:
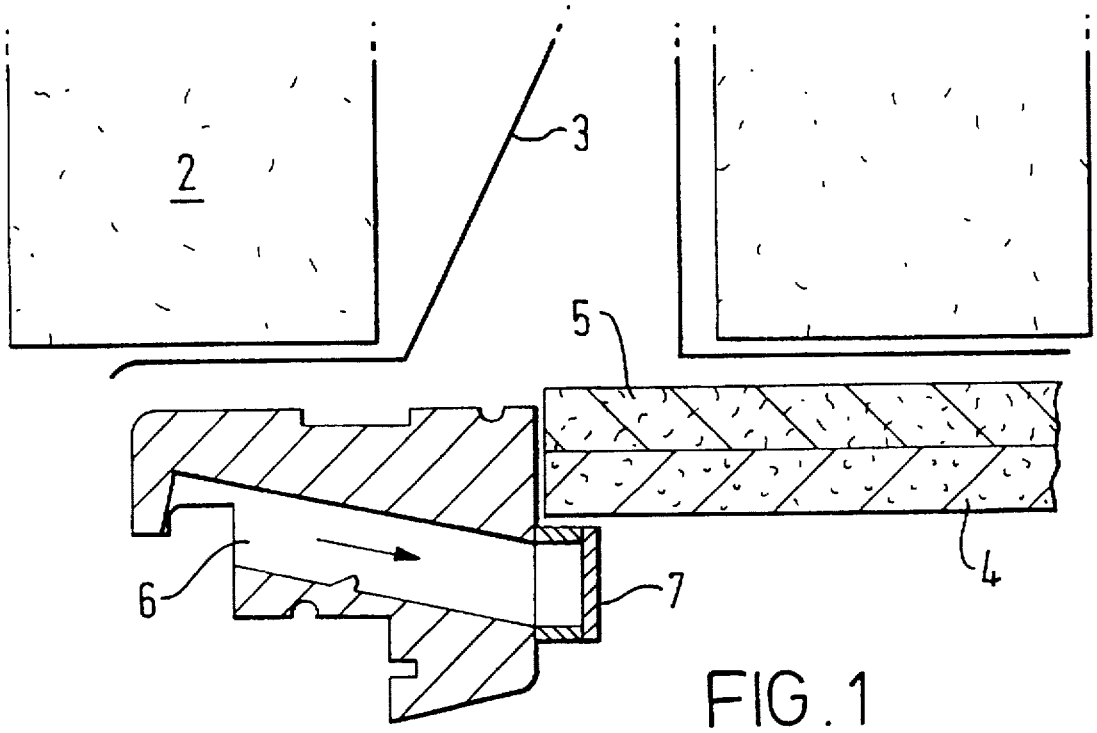
FIG. 1 is a sectional side view of the prior art ventilator arrangement.

Referring firstly to the prior art arrangement shown in FIG. 1, a frame 1 in which a window is mounted (not shown) is provided in a suitable opening in a brick wall 2 of a building, a lintel 3 providing structural support. The part of the frame 1 shown extends along the top of the window. An interior finish such as a layer of plaster board 4 and a layer of insulation 5 is applied to the interior of the building. As can be seen from FIG. 1 the interior of the building is to the right of the frame as it appears in the drawing. Ventilation to the interior of the structure is provided by a slot 6 extending from the exterior of the sash to the interior, and a ventilator 7 mounted at one end of the slot. In order for the ventilator 7 to clear the interior finish (layers 4 and 5) the slot 6 slopes diagonally downwards from the exterior to the interior.

Figure 2:
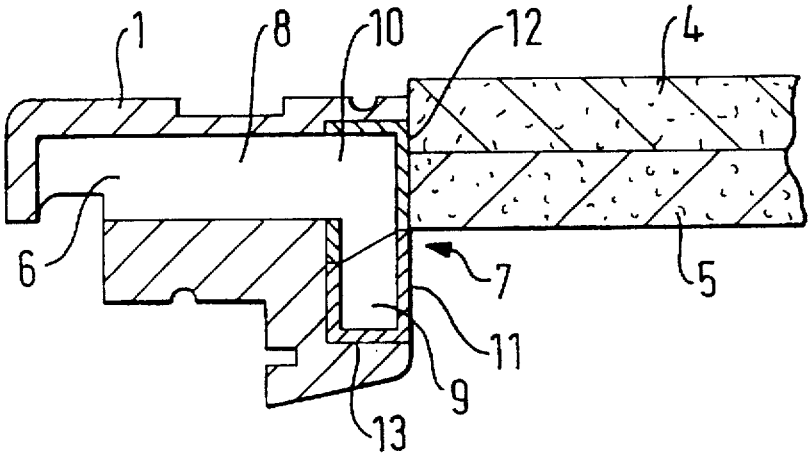
FIG. 2 is a sectional side view of a ventilator arrangement according to the present invention.

In FIG. 2 an improved ventilator arrangement according to the present invention can be seen. Where appropriate the same reference numerals have been used to represent corresponding parts. A slot 6 of L-shaped section is provided having a horizontal portion 8 extending from the exterior opening in the frame 1 and a downwardly directed vertical portion 9 communicating along its length with the interior. The ventilator 7 is inserted in the slot 6, principally in the vertical portion 9. The slot extends in a plane coming out of the page to a dimension giving the desired level of ventilation, and the ventilator is shaped to be a snug fit in the vertical portion 9 of the slot.

Figure 4:
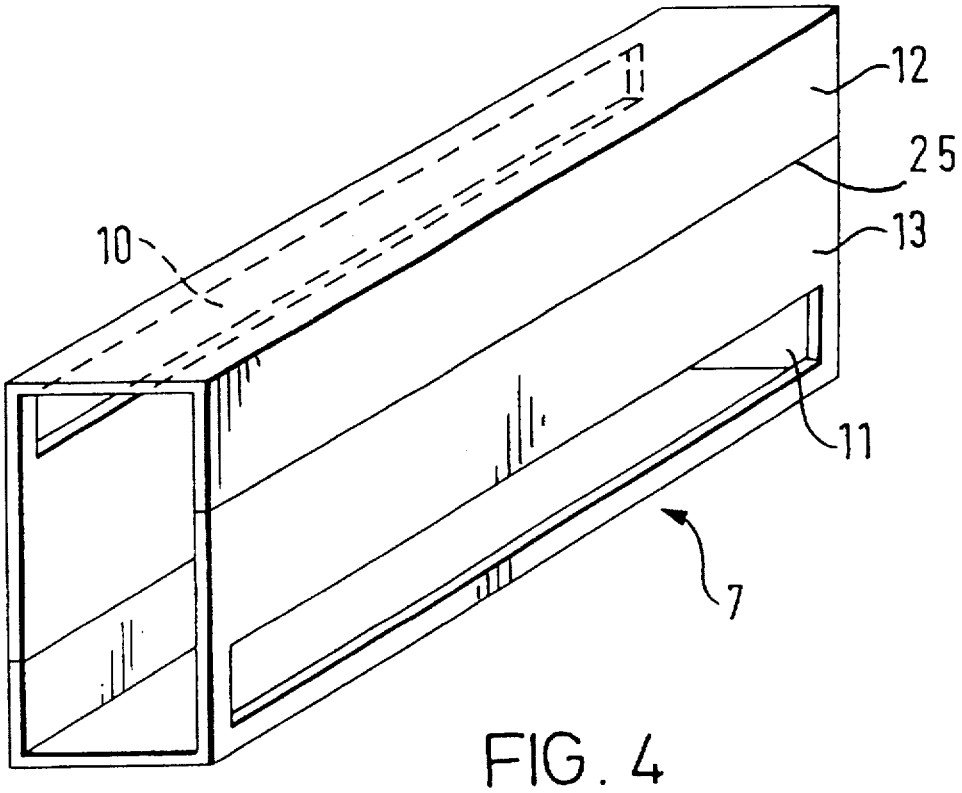
FIG. 4 is a view of a ventilator according to the present invention.

As shown in FIG. 4 the ventilator 7 comprises an elongate main body of rectangular cross-section having two parallel long walls and two parallel short walls. First and second openings 10 and 11 are provided towards one long edge of each long wall, the openings 10, 11 being substantially diametrically opposed. The openings 10, 11 can, for example, be longitudinal slots or grilles. When the ventilator 7 is positioned in the frame 1 the opening 10 communicates with the exterior via the horizontal portion 8 of the slot 6, and the opening 11 communicates with the interior. A closure member (not shown) of a known type such as a hit and miss closure or a parallel motion closure is provided on the main body and can be operated to cover or uncover the opening 11 to control the passage of air through the slot 6 and ventilator 7.

Alternatively, the opening 11 can be permanently open and formed, for example, as a grille, in which case no closure member is required.

The main body of the ventilator 7 is formed of two detachably secured parts; an upper part 12 and a lower part 13. The parts 12, 13 join along a plane parallel or inclined with respect to the short walls of the main body so that the opening 10 is provided in the upper part 12, and the opening 11 and the closure member are provided on the lower part 13. The parts may be secured together by, for example, grub screws or a snap-fit. Alternatively the main body may be integrally formed with the upper and lower parts 12, 13 meeting at a line of weakness so that they can be separated simply by applying stress to the line of weakness, or cutting along it. The main body of the ventilator 7 and the closure member may be formed of any suitable material, for example an aluminium casting, a plastics moulding, or an aluminium or plastics extrusion.

As can be seen, the parts 12, 13 can be identically shaped, one of the parts being rotated to fit the other part. In that case tooling costs can be reduced.

In order to fit into the slot the ventilator 7 can be manufactured or cut to a required size. Alternatively, part or all of the ventilator can be formed in units arranged to be placed side by side to form a ventilator of a desired length. For example, the upper part 12 could be formed as a series of units and a single lower part 14 extending across all of the upper parts could be provided, or both the upper and lower parts could be formed as units.

The ventilator 7 is installed before the interior finish (layers 4, 5) is applied. To install the ventilator it is positioned in the slot and the lower part 13 is secured to the frame by securing means (not shown) of a known type, for example one or more screws passing through an aperture in the lower part 13 and into the frame (See FIG. 3). Because the upper and lower parts 12, 13 are secured together the upper part is thus held in place once the lower part has been secured.

Alternatively the upper and lower parts 12, 13 need not even be secured together; because the plane of the boundary between the parts slopes upwardly in a direction away from the sash, once the lower part 13 has been secured the upper part is held firmly between the top of the sash and the "overlap" between the parts. The interior finish is applied once the ventilator has been fixed in place; once the interior finish has been applied the upper part is plastered in and thus fixed in position. The upper part can also be fixed in place by screwing etc. before the interior finish is applied. In that case the upper and lower parts can be formed separately and will simply abut one another when installed, no overlap being required.

Figure 3:
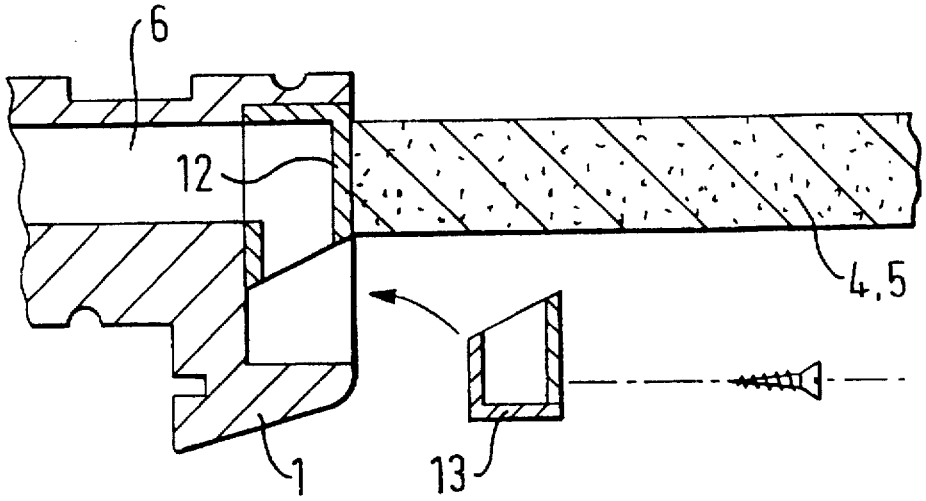
FIG. 3 shows part of the ventilator arrangement of FIG. 2 being replaced.

If it is desired to repair or replace the lower, operational part 13, for example because the closure member has jammed, this may be easily achieved simply by unscrewing or otherwise detaching the lower part from the frame and separating it from the upper part as appropriate, by unscrewing it or cutting along the weak line 25. If the parts were not attached together but the upper part 12 was simply held in place by the lower part 13, the lower part 13 may simply be pulled away. As shown in FIG. 3 a repaired or replacement lower part 13 may be inserted back into the vent very simply and secured in position once again. The upper part 12 is held in position during the operation by the interior finish. As indicated above, a closure member need not be provided; the lower part may still need to be removed however, for example for cleaning purposes. A part including a closure member could be replaced by a part without a closure member.

In an alternative arrangement, still in accordance with the invention, the ventilator may comprise simply a front plate screwed or otherwise fixed over the opening of the slot to the interior. An opening is provided on the lower part of the plate and the lower part of the plate is separable from the upper part as described above. The ventilator is installed prior to application of the interior finish and affixed to the frame as described above. In a further variation, the "lower part" comprises simply a cover plate to be mounted on the "upper part" which comprises a backing plate.

As a result of the configuration of the ventilator 7, a slot having a horizontal exterior portion can be provided as a result of which the opening to the exterior is of smaller dimension. At the same time a ventilator can be positioned in the slot so as to allow better clearance from the internal building finishes. In addition, should the ventilator need replacement, the lower part can be removed and repaired or replaced without any disruption to the interior finish.

It will be appreciated that the ventilation arrangement is not restricted to use with windows but is equally suitable in any application where ventilation is required in locations with inadequate clearance. Similarly, the ventilation arrangement may equally be mounted vertically, for example in a vertical portion of a window or door frame, where clearance from an adjacent vertical wall is required.

Figure 5:
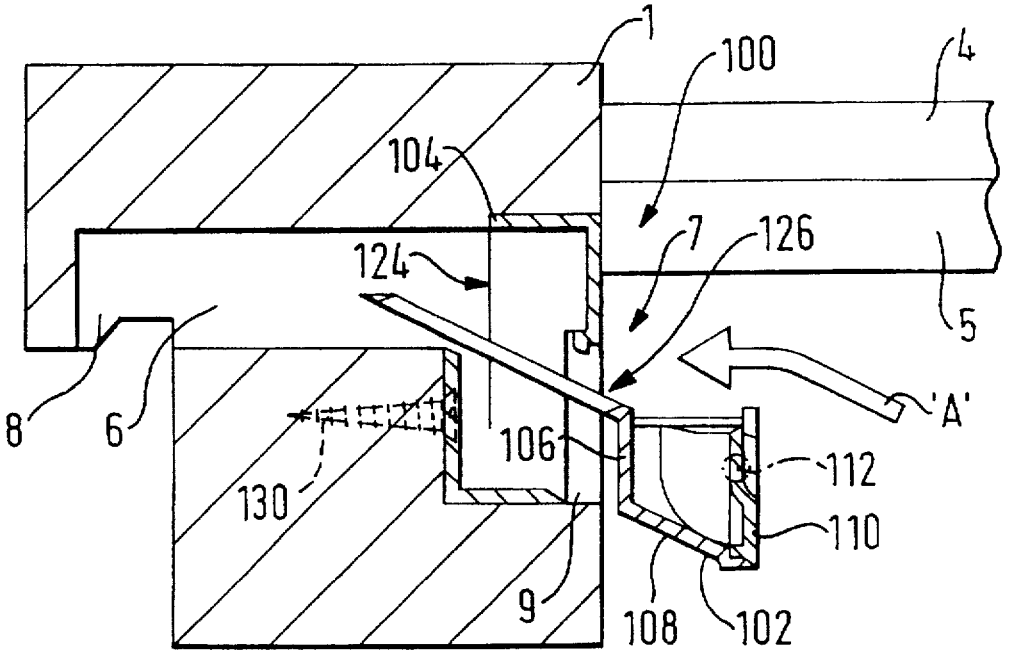
FIG. 5 is a sectional side view of another preferred embodiment of a ventilator and ventilator arrangement according to the present invention, during installation.
Figure 6:
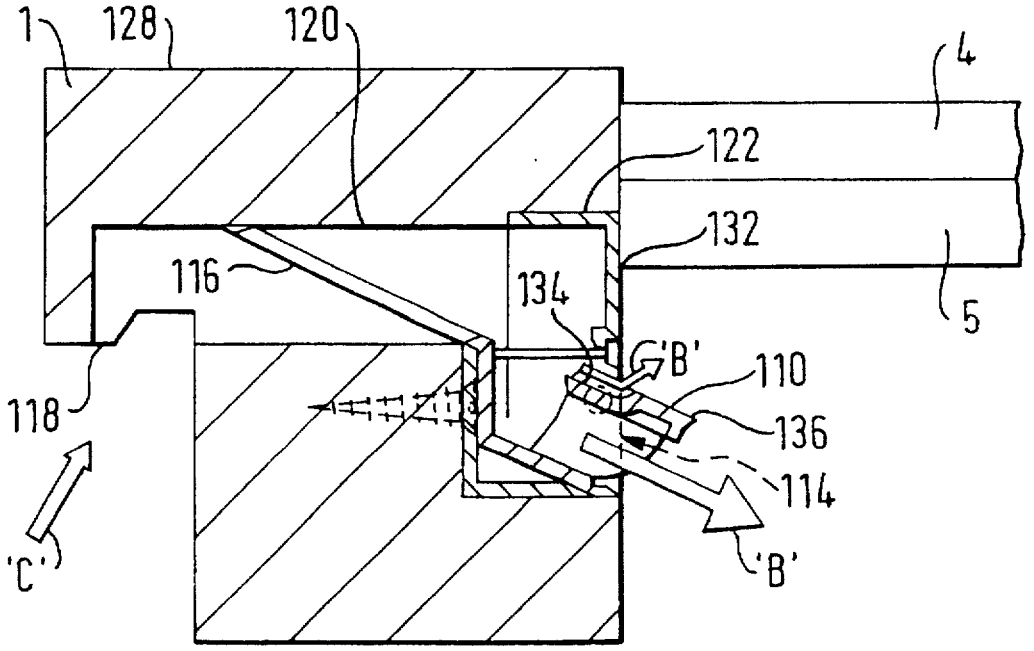
FIG. 6 is a sectional side view of the arrangement of FIG. 5 in an installed position.

FIGS. 5 and 6 show an alternative preferred ventilator and ventilation arrangement. As shown in FIG. 5, a window frame 1 is provided and is, again, located adjacent interior finish consisting of a layer of plaster board 4 and a layer of insulation 5. A ventilation slot 6 passes through the frame 1 from one side thereof to the other. The slot has an L-shaped section having a horizontal portion 8 and a downwardly directed vertical portion 9.

The preferred ventilator 7 of this embodiment is inserted in a slot, principly in the vertical portion 9.

As shown in FIG. 5, the ventilator 7 comprises an elongate main body 100 of generally rectangular cross-section and having two parallel long walls and two parallel short walls.

The body 100 consists of first 102 and second 104 parts.

In FIG. 5, the first part 102 is shown during installation into the second part 104. Prom the position shown in FIG. 5, the second part is pushed in direction "A".

The first part 102 has the shape of a trough and includes a rear wall 106 and lower wall 108. The first part 102 also includes a front wall 110 which is rotatable about an axis 112 to open and close an opening 114 formed through the body of the first part 102. In FIG. 5, the rotatable front wall 110 is closed, but it may be rotated to an open position as shown in FIG. 6 where ventilation may pass through the ventilator 7 and its opening 114 in the directions marked "B" in FIG. 6.

The first part 102 also includes a grille 116 which, once installed, acts as an insect screen. The grille 116 also improves the cosmetic appearance of the ventilation assembly when viewed through the outer side 118 of the ventilation slot 6 in the direction "C", since it hides the top surface 120 of the slot 6 at least partly from view. In many applications, such as where the frame 1 is of wood, the surface 120 at the top of the slot may be unfinished.

The second part 104 of the ventilator 7 of FIGS. 5 and 6 is in the form of a rectangular box-shaped housing 122. The housing 122 has an inlet opening 124 communicating with the horizontal portion 8 of the slot 6. The housing 122 also includes a receiving aperture 126 for receiving the trough-shaped body of the first part 102 of the ventilator 7. The inlet opening 124 and receiving aperture 126 are at diametrically opposed corners of the housing 122. Thus, the receiving aperture 126 for the first part 102 of the ventilator is below the inlet opening 124 and, once installed, the receiving aperture 126 and the opening 114 in the first part 102 of the ventilator are spaced down from the outer periphery 128 of the frame 1. Accordingly, the layers of plaster board 4 and insulation 5 are above the receiving aperture 126 and the opening 114. Therefore, the first part 102 of the ventilator can be installed and removed from the second part 104 (which is fixed in place by screws 130), without disturbing the plaster board 4 and insulation 5.

The upper front surface 132 of the second part 104 may include a series of projections and indentations (not shown) such as a series of longitudinal troughs along the length of the ventilator, to enable keying of the plaster board or insulation, or plaster or such-like. The ventilator may be provided with seals between the outer surfaces thereof and the frame 1. The rotatable front wall or ventilation controlling flap 110 of the first part 102 of the ventilator may be provided with gaskets along the longitudinal edges thereof in order to improve weather tightness when closed.

The parts of the ventilator may be of various materials and, for example, the flap 110 may be metal such as a one piece die-casting or aluminium extrusion. The flap 110 may have end caps (not shown), such as of plastics, to enable the hinging thereof about the axis 112.

The first part 102 of the ventilator is preferably a snap-fit into the second part 104. Advantageously, the ventilator, once installed is flush fit with the frame 1 and the screw fixings 130 are concealed from view. The ventilator is easily removable from the inner side of the frame for cleaning or replacement. Instead of being provided with a rotatable flap 110, the ventilator could be provided with a permanent and fixed level of ventilation, such as by an arrangement of louvres at the opening 114 to provide, for example 3,600 sq.mm of air opening at the opening 114. The version described above with reference to FIGS. 5 and 6 of the ventilator may provide an infinitely variable ventilation opening at the opening 114, up to say 4,000 sq.mm. The rotatable flap 110 may be rotated for operation in various ways, such as by manual operation by pressing on an upper recessed portion 134 thereof to open the ventilator and on a lower portion 136 thereof to close the ventilator.

It is envisaged that two or more ventilation units 7 could be placed side by side, recessed into the vertical portion of a ventilation slot which in length is two or three times or another multiple of the length of the ventilator 7. For example, two ventilators 7 like those described in FIGS. 5 and 6 could be placed next to each other in a ventilation slot to provide up to 8,000 sq.mm of air opening.

I claim:

1. A vented window or door frame including an air passage extending from exterior side to an interior side of the frame, and an elongate ventilator positioned at the interior side of the frame and extending along the frame and communicating with the air passage, the ventilator comprising a main body having separable first and second parts, a first ventilation opening being provided in the first part at an end of the ventilator remote from the periphery of the frame, the frame being located with the second part of the ventilator adjacent a layer of interior building finish on the interior side of the frame, the first part of the ventilator being on the interior side of the frame and spaced from the layer of interior building finish such that the first part can be removed without disruption to the interior finish.

2. A vented frame as claimed in claim 1 in which the air passage comprises an L-shaped slot having a first leg extending substantially transverse to the plane of the frame from the exterior of the frame and a second leg extending substantially normal to the first leg.

3. A vented frame as claimed in claim 1 which includes a closure member associated with the first opening for covering and uncovering the first opening.

4. A vented frame as claimed in claim 1 in which the first part and second part are releasably attached to one another by a snap fit.

5. A vented frame as claimed in claim 1 in which the first and second parts are releasably attached to one another by a weak line at the boundary between them.

6. A vented frame as claimed in claim 1 in which the main body has a second ventilation opening in the second part, and an air passage communicating between the openings.

7. A vented frame as claimed in claim 6 in which the main body is elongate and hollow and of rectangular cross-section, each opening being provided on a respective long wall of the main body adjacent one long edge thereof, the openings being substantially located at respective ends of an imaginary diagonal line drawn through the cross-section of the main body.

8. A vented frame as claimed in claim 1 in which the ventilator is formed from a plurality of adjacent units.

9. A vented frame as claimed in claim 1 in which the first and second parts are joined along lines parallel to the long edges of the main body.

10. A vented window or door frame including an air passage of L-shaped section having a first leg extending substantially transverse to the plane of the frame from an exterior side of the frame, and a second leg extending substantially normal to the first leg, and ventilator positioned in the second leg, the ventilator comprising an elongate rectangular main body having a first opening for communicating with an interior side of the frame and a second opening for communicating with the exterior side of the frame via the L-shaped passage and an air passage communicating between the openings, the first opening being provided at an end of the ventilator remote from the periphery of the frame.

11. A vented frame as claimed in claim 10 in which the ventilator comprises a main body having separable first and second parts which are releasably attached to one another by a snap fit.

12. A vented frame as claimed in claim 10 in which the ventilator comprises a main body having separable first and second parts which are releasably attached to one another by a weak line at the boundary between them.

13. A vented frame as claimed in claim 10 in which the ventilator comprises a main body having separable first and second parts, the main body has a second ventilation opening in the second part, and an air passage communicating between the openings, and the main body is elongate and hollow and of rectangular cross-section, each opening being provided on a respective long wall of the main body adjacent one long edge thereof, the openings being substantially located at respective ends of an imaginary diagonal line drawn through the cross-section of the main body.

14. A vented window or door frame including an air passage extending from an exterior side of the frame to an interior side of the frame, the air passage comprising an L-shaped slot having a first leg extending substantially transverse to the plane of the frame from the exterior side of the frame and a second leg extending substantially normal to the first leg, and an elongate ventilator, the ventilator comprising an elongate main body of rectangular cross-section and having two parallel long walls and two parallel short walls, the main body being located in the second leg of the slot, the main body having separable first and second parts, a first ventilation opening being provided in the first part at an end of the ventilator remote from the periphery of the frame.

15. A vented frame as claimed in claim 14 in which the first and second parts are releasably attached to one another by a snap fit.

16. A vented frame as claimed in claim 14 in which the first and second parts are releasably attached to one another by a weak line at the boundary between them.

* * * * *